US005655391A

United States Patent [19]

Long

[11] Patent Number: 5,655,391

[45] Date of Patent: Aug. 12, 1997

[54] PADLOCKS

[75] Inventor: Russell Phillip Long, Eltham, Australia

[73] Assignee: R.P.L. Industries Pty. Ltd., Victoria, Australia

[21] Appl. No.: 393,609

[22] Filed: Feb. 23, 1995

Related U.S. Application Data

[63] Cintinuation-in-part of PCT/AU93/00421 Aug. 18, 1993 published as WO94/04781 Mar. 3, 1994.

[30] Foreign Application Priority Data

Aug. 26, 1992 [AU] Australia ..... PL4315/92

[51] Int. Cl.[6] ..... E05B 67/38

[52] U.S. Cl. ..... 70/56; 70/417

[58] Field of Search ..... 70/56, 55, 54, 70/52, 50, 20, 51, 43, 46, 38 B, 416, 419, 417, 422, DIG. 58, 53

[56] References Cited

U.S. PATENT DOCUMENTS

| | | | |
|---|---|---|---|
| 456,744 | 7/1891 | Sparks | 70/52 |
| 883,414 | 3/1908 | Merrill | 70/52 |
| 920,691 | 5/1909 | Towne | 70/52 |
| 980,608 | 1/1911 | Cosgrove | 70/52 |
| 1,051,139 | 1/1913 | Lovett | 70/52 |
| 1,333,355 | 3/1920 | Voight | 70/417 |
| 1,408,771 | 3/1922 | Nielsen | 70/38 B |
| 1,542,106 | 6/1925 | Spencer | 70/54 |
| 1,566,473 | 12/1925 | Gibson | 70/51 |
| 1,662,612 | 3/1928 | Junkunc | 70/55 |
| 1,897,922 | 2/1933 | Bradshaw | 70/52 |
| 2,541,638 | 2/1951 | Clevett | 70/56 |
| 2,814,940 | 12/1957 | Miller | 70/52 |
| 3,848,440 | 11/1974 | Manuel . | |
| 3,858,419 | 1/1975 | Hampton . | |
| 3,858,923 | 1/1975 | Bunn | 70/52 |
| 3,916,654 | 11/1975 | Mudge, Jr. | 70/56 |
| 4,300,370 | 11/1981 | Kaiser et al. | 70/54 |
| 4,372,138 | 2/1983 | De Forrest | 70/56 |
| 4,905,486 | 3/1990 | Appelbaum | 70/54 |
| 5,027,626 | 7/1991 | Appelbaum | 70/164 |
| 5,063,765 | 11/1991 | Squire et al. | 70/417 |
| 5,146,771 | 9/1992 | Loughlin . | |
| 5,152,160 | 10/1992 | Lentini | 70/51 |
| 5,179,848 | 1/1993 | Kief | 70/51 |

FOREIGN PATENT DOCUMENTS

| | | | |
|---|---|---|---|
| 57622/80 | 11/1980 | Australia . | |
| WO85/01981 | 4/1983 | Australia | 70/20 |
| 26903/88 | 6/1989 | Australia . | |
| 38235/89 | 1/1990 | Australia . | |
| 338405 | 8/1920 | Germany . | |
| 1279 | of 1886 | United Kingdom | 70/52 |
| 1365684 | 9/1974 | United Kingdom . | |
| 1449101 | 9/1976 | United Kingdom . | |
| 2169343 | 12/1984 | United Kingdom | 70/54 |
| 8501981 | 5/1985 | WIPO . | |
| 9219833 | 12/1992 | WIPO . | |

*Primary Examiner*—Steven N. Meyers
*Assistant Examiner*—Donald J. Lecher
*Attorney, Agent, or Firm*—Knobbe, Martens, Olson & Bear, LLP

[57] ABSTRACT

A padlock has an outer body part which prevents the application of torque from a wrench to force the shackle open. One or both ends of the padlock are also configured to prevent application of a wrench, the configuration being generally conical spheroidal or tapered configuration preferably at least at the shackle end of the body of the padlock.

23 Claims, 5 Drawing Sheets

PADLOCKS

RELATED APPLICATIONS

This is a continuation-in-part application of PCT application No.PCT/AU93/00421 filed Aug. 18, 1993.

BACKGROUND OF THE INVENTION

Conventional padlocks are relatively easy to force open. Usually, all that is necessary is to separately grip the body of the padlock and the bolt or shackle of the padlock and to force the shackle open from the body. Even hardened padlocks can be forced in this way by using a suitable wrench.

SUMMARY OF THE INVENTION

According to the present invention there is provided a padlock comprising a body and a shackle mounted on the body for movement between a closed, locked, position and an open, released condition, wherein the body comprises an inner body part which mounts the shackle and an associated locking mechanism, and an outer body part mounted on the inner body part for rotation about the longitudinal axis of the body, said outer body part having a length sufficient to shield the inner body part against the application of a torque acting about the longitudinal axis of the inner body part to force the padlock, and the body having at least at one end portion a formation which progressively reduces in cross-sectional dimension whereby to impede the application of a wrench to the body such that the jaws of the wrench are applied to the opposite ends of the body.

Further according to the present invention, there is provided a padlock comprising a body and a shackle mounted on the body for movement between a closed, locked, position and an open, released condition, wherein the body comprises an inner body part which mounts the shackle and an associated locking mechanism, and an outer body pat mounted on the inner body part and configured to prevent the application of a torque acting about the longitudinal axis of the inner body part to force the padlock, and the body having at least at one end portion a formation which progressively reduces in cross-sectional dimension whereby to impede the application of a wrench to the body and to deflect hammer blows to the body.

In a preferred embodiment, the said formation is a generally conical formation on the inner body part at the shackle end of the body. Alternatively or in addition the said formation may be at the end of the inner body part remote from the shackle end.

BRIEF DESCRIPTION OF THE DRAWINGS

Embodiments of the invention will now be described, by way of example only, with reference to the accompanying drawings in which.

DETAILED DESCRIPTION OF THE PREFERRED EMBODIMENTS

Figure 1:
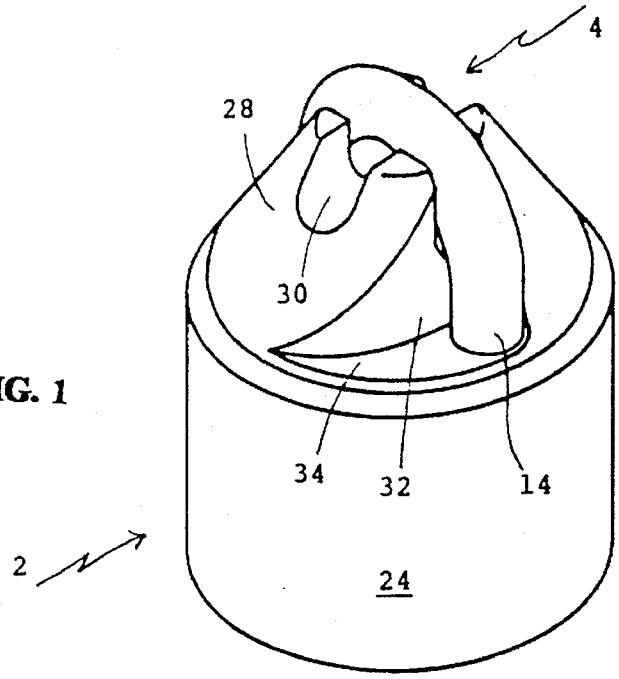
FIG. 1 is a perspective view of a padlock in accordance with the preferred embodiment of the invention.
Figure 2:
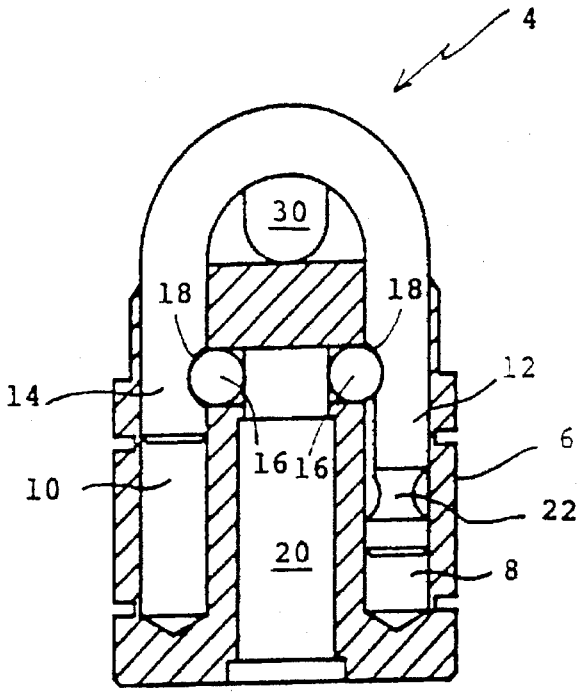
FIG. 2 is a longitudinal section through the padlock to show schematically the operating components, a rotatable outer body part being omitted for the sake of clarity.
Figure 3:
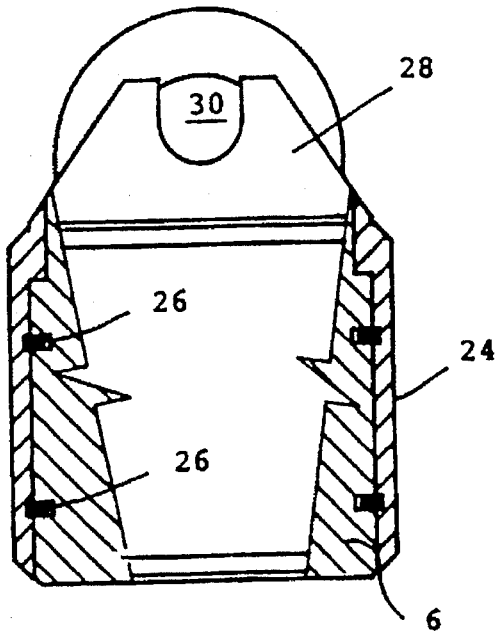
FIG. 3 is a longitudinal section showing the mounting of the outer body part on the inner body part.

The padlock shown in FIGS. 1 to 3 of the accompanying drawings comprises a body 2 and a curved bolt or shackle 4. The body 2 consists of an inner body part 6 of a substantially cylindrical shape. The inner body part has diametrically-opposed longitudinally extending bores 8, 10 which receive opposed arms 12, 14 of the shackle 4. The arm 12 of the shackle is longer than the arm 14 and is displaceable in the bore 8 between an inner locked position in which the shorter arm 14 is within the bore 10, and an outer released position in which the end of the shorter arm 14 is fully withdrawn from the bore 10 to permit the shackle 4 to be applied to an article to be secured. The shackle 4 is held in its locked condition by locking means 16 which engage into recesses 18 on the inner surfaces of the arms 12, 14. The locking means 16 is releasable by actuation of a rotary lock mechanism 20 mounted within the inner body part 6. A key for releasing the lock mechanism 20 is inserted into the lock mechanism from the underside of the inner body part 6. In the open condition of the shackle 4, the locking means 16 engages within a further recess 22 formed at the lower end portion of the longer arm 12 to retain the shackle 4 against withdrawal from the body part 6 and to permit the shackle to swivel about the axis of the longer arm 12. The lock mechanism 20 and the locking means 16 can be of substantially conventional construction and will not be described in detail herein.

An outer body part 24 is rotatably mounted on the inner body part 6 by bearings 26. The outer body part 24 is also of substantially cylindrical form and extends over the entire cylindrical outer surface of the inner body part 6. The cylindrical outer surface of the outer body part 24 and its rotatable mounting on the inner body part 6 prevents a wrench from being applied to the body to provide a reaction force acting about the longitudinal axis of the body in opposition to a force applied to the shackle 4 in an attempt to force open the shackle.

We have also determined that for proper security it is necessary to configure the body so that a wrench cannot be applied to the body with the ends of the body held firmly between the jaws of the wrench. In the embodiment shown this is achieved by forming the shackle end portion of the body with a generally conical shape which provides a minimum of surface area on which a wrench jaw can grip. The conical end portion 28 is formed as an extension of the inner body part 6 and includes a recess for receiving the looped part of the shackle and a passage 30 which intersects that recess for receiving a component such as a chain link to be held by the shackle 4. In the embodiment shown, the conical end portion 28 is cut-away at 32 adjacent the bore 10 for the shorter arm 14 of the shackle 4, This cut-away portion 32 enables the shackle 4 to be swung open without the necessity of providing the shackle 4 with longitudinal movement sufficient to enable the end of the shorter arm 14 to clear the conical formation. Although this cut-away portion 32 does provide a surface 34 generally transverse to the longitudinal axis of the body, this surface is very small and is most unlikely to represent an area on which a sufficient grip could be obtained, especially as it is at the edge of the body. However, this surface 34 could, if necessary, be inclined at an acute angle to the longitudinal axis of the body, for example by being sloped downwardly towards the outer edge of the body in order to ensure that it is not parallel to a surface at the opposite end of the body. In an alternative configuration, the shackle 4 can be constructed to have sufficient longitudinal movement to permit the shorter arm 14 to be raised clear of the conical formation without the need for the cut-away portion.

Figure 4:
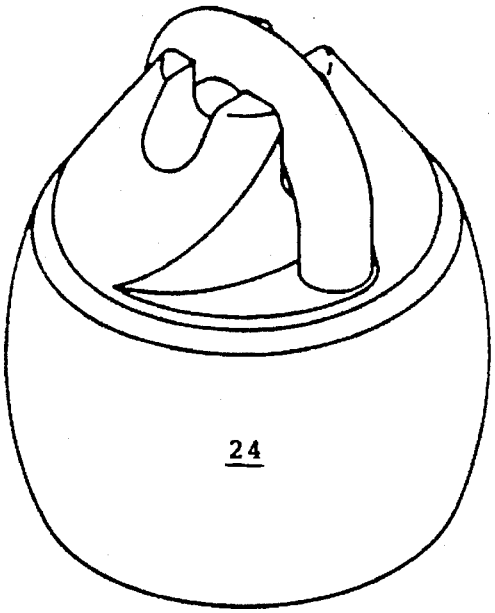
FIGS. 4 to 6 are perspective views showing further embodiments of the invention.
Figure 5:
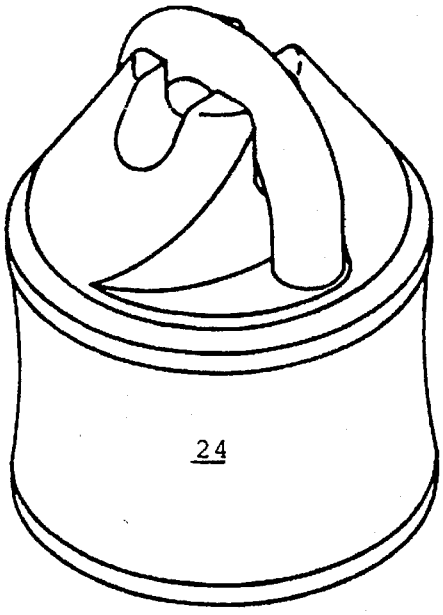

The rotatable outer body part 24 may have a shape other than cylindrical. For example as shown in FIG. 4 the outer body part 24 is of convex form and in FIG. 5 it is of concave form. In each case, the outer body part 24 is of annular section and is rotatably mounted on the inner body part.

Figure 6:
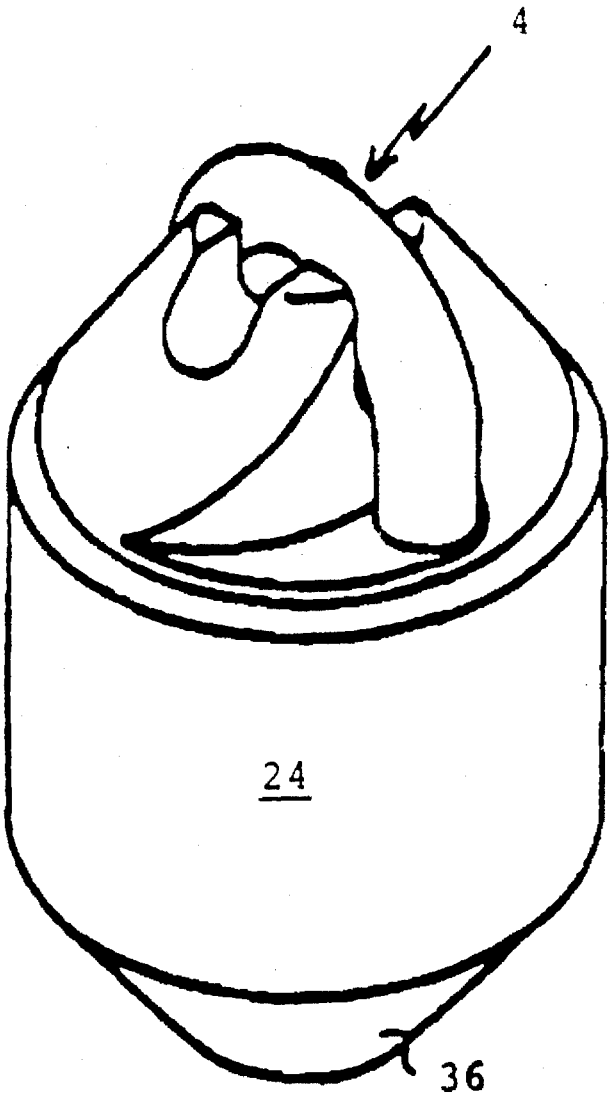

In the embodiment shown in FIG. 6, the opposite end of the inner body part is also provided with a conical formation 36 which minimises at that end the transverse surface area on which the jaw of a wrench can grip.

Figure 7:
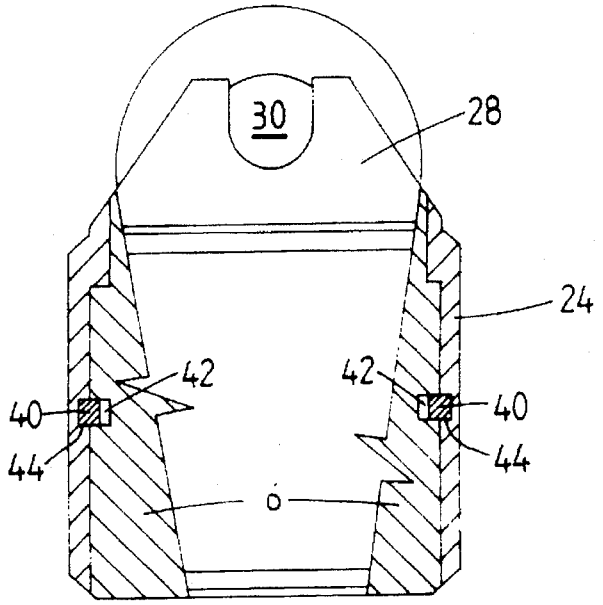
FIG. 7 is a longitudinal section through another embodiment of the padlock.

In the embodiment shown in FIG. 7 the outer rotatable body part 24 is mounted on the inner body part 6 by means of a resilient split ring or circlip 40 of rectangular cross-section fitted into grooves 42,44 in the inner body part 6, and outer body part 24. The circlip 40 may either have inherent lubricating properties, for example formed by a coating of P.T.F.E., or may alternatively carry one or more plastics facing layers which act as bearing layers. Alternatively the circlip can fit into one or more plastics bearing rings which may be fitted into one or both of the grooves 42 or 44 in the inner and outer body parts 6,24. The use of the circlip 40 facilitates assembly of the padlock. The circlip 40 is initially mounted into the groove 42 in the inner body part 6 and is held in a reduced diameter, circumferentially compressed, state while the outer body part 24 is mounted over the inner body part 6 until the groove 44 in the outer body part 24 aligns with the circlip 40, at which point the circlip expands into the outer groove 44. Although as shown in FIG. 7 there is only a single circlip 40 used to rotatably mount the outer body part 24 to the inner body part 6, there may be two or more such circlips arranged at spaced positions along the length of the inner body part 6.

In the embodiment shown in FIG. 7 the circlip 40 and/or the associated plastics components provide the bearing surfaces between the outer and inner body parts 24,6. In an alternative construction, the inner body part 6 may be fabricated from a high strength plastics which also forms a bearing surface with the inner surface of the outer body part 24, in which case the function of the circlip(s) 40 is simply to retain the outer body part 24 to the inner body part 6.

In each of the embodiments thus far described the incorporation of the outer body part 24 around the inner body part 6 also has an important function in providing increased hoop strength to the construction of the body whereby the inner body part 6 is prevented from expanding radially outwardly as a result of compressive loading under the effect of substantial hammer blows which might otherwise sufficiently deform the inner body to an extent which enables the shackle to be withdrawn.

Figure 8:
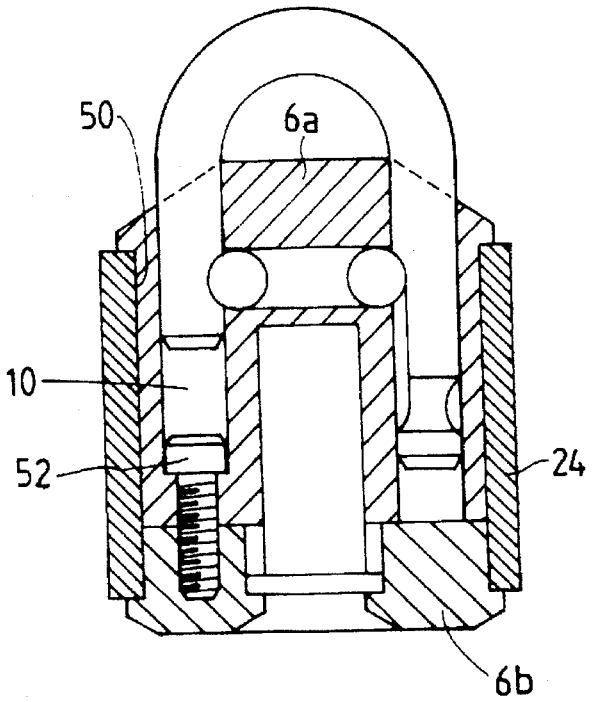
FIG. 8 is a longitudinal section through yet another embodiment of the padlock.
Figure 9:
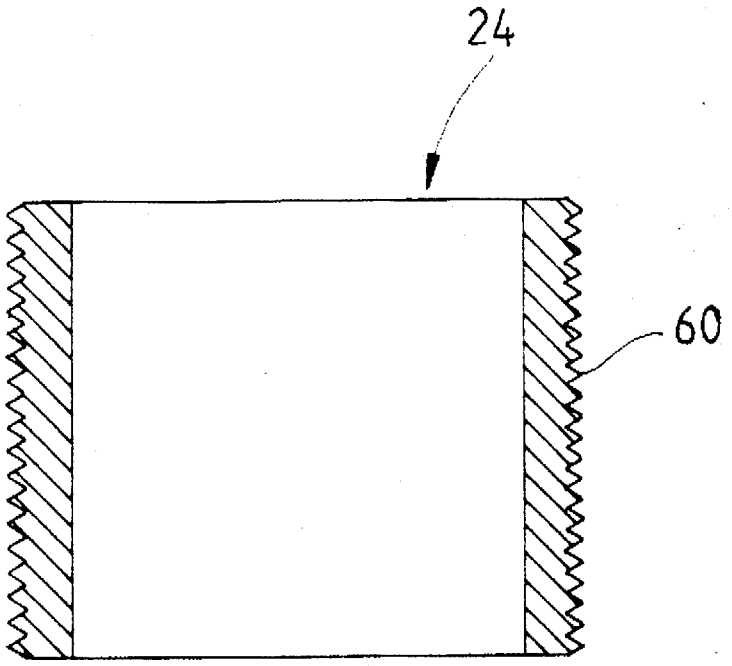
FIG. 9 is a section through an alternative form of outer body part for the padlock.

Although it is preferred for the outer body part to rotate on the inner body part, substantial resistance to forcing of the padlock can also be obtained even if the outer body part is non-rotatable, provided that other measures are taken to prevent torque from being applied. In FIG. 8 the outer body part 24 is seated within an annular groove 50 formed on the inner body part, and the inner body part is itself of two-part construction Consisting of a main portion 6*a* and a lower end portion 6*b* which is separable from the main portion 6*a* to permit assembly of the outer body pan 24 to the inner body part, with the lower end portion 6*b* then being secured in position to retain the outer body part by means of a screw 52 inserted through the end of the bore 10 and into the lower end portion 6*b*. In this embodiment the outer body part 24 is not intended to rotate and resistance to torque is provided by making the outer body part sufficiently hard to resist application of a wrench or other torque-applying means with sufficient grip that a damaging torque can be applied. A similar effect can be achieved by shaping the external surface of the outer body part 24 to provide a series of axially-spaced annular formations 60 (see FIG. 9) which prevent application of a wrench or other torque-applying means with a grip which enables a damaging torque to be applied. Although in the embodiment illustrated the outer body part 24 is not rotatable on the inner body part, this construction could readily be designed for outer body part rotation by providing sufficient tolerance between the axial ends of the outer body part 24 and annular groove 50 and also by fabricating the two portions 6*a*, 6*b* of the inner body part from a high strength plastics which will provide a sufficient bearing surface for the outer body part without needing additional lubrication.

In each of the embodiments described herein the conical formation at the shackle end of the body provides a progressively reducing cross-sectional dimension which prevents the application of a wrench across the ends of the body with sufficient force to firmly hold the padlock. It will be appreciated that shapes other than a conical shape can be used to achieve a similar result, for example a spheroidal shape or another shape which provides a narrowing or tapered configuration. It is important to note that this shaped configuration of the shackle end of the body not only acts to resist the application of a wrench but also serves to deflect hammer or axe blows which might be applied to the end of the body in an attempt to force the shackle.

The embodiments have been described by way of example only and modifications are possible within the scope of the invention.

I claim:

1. A padlock comprising a body having a longitudinal axis and a shackle mounted on the body for movement between a closed, locked position and an open, released position, wherein the body comprises an inner body part which mounts the shackle and an associated locking mechanism, and an outer body part mounted on the inner body part for relative rotation about the inner body part about the longitudinal axis of the body, said outer body part having a length sufficient to shield the inner body part against the application of a torque acting about the longitudinal axis of the body to force the shackle of the padlock, and the inner body part at the shackle end of the body having a generally conical formation having sides extending around, and tapering towards, said longitudinal axis whereby the application of the jaws of a wrench to the opposite sides of the body and shackle is impeded by the generally conical formation when the shackle is in the locked position.

2. A padlock according to claim 1, wherein the said formation is a generally conical formation at the end of the inner body part remote from the shackle end.

3. A padlock according to claim 1, wherein the conical formation is cut away at one side to permit the shackle to swing between said open and closed positions.

4. A padlock according to claim 1, further comprising another formation at the other end of the inner body part remote from the shackle end, said another formation being generally conical.

5. A padlock according to claim 4, wherein the conical formation at the shackle end of the inner body part is cut away at one side to permit the shackle to swing between said open and closed positions.

6. The padlock of claim 1, wherein said outer body comprises a generally convex shape.

7. The padlock of claim 1, wherein said outer body comprises a generally concave shape.

8. A padlock according to claim 1, wherein the said formation is a generally spheroidal formation on the inner body part at the shackle end of the body.

9. A padlock comprising a body and a shackle mounted on the body for movement between a closed, locked position and an open, released position, wherein the body comprises an inner body part which mounts the shackle and an associated locking mechanism, and an outer body part mounted on the inner body part and having a generally curved shape to prevent the application of a torque acting about the longitudinal axis of the inner body part to force the padlock, and the body having at least at one end portion a formation around the shackle impeding the application of a wrench to the body and to deflect hammer blows to the body by having a generally conical surface around the shackle and tapering toward and encompassing a portion of a distal the end of the shackle when the shackle is in the closed position.

10. A padlock according to claim 9, further comprising means mounting the outer body part on the inner body part for rotation about the longitudinal axis of the inner body.

11. A padlock according to claim 10, wherein the mounting means comprises at least one split ring engaging in opposed grooves in facing surfaces of the inner and outer body parts.

12. The padlock according to claim 9, wherein the outer body part is securely received in an annular groove of the inner body part, the outer body part providing hoop resistance to resist circumferential deformation of the inner body part consequent on compressive loading applied to the inner body part by hammer blows.

13. A padlock according to claim 9, wherein the outer body part is provided with a series of annular formations which prevent application of torque-applying means with a force which grips the body sufficiently to enable the padlock to be forced.

14. The padlock of claim 9, wherein said curved shape of said outer body is generally convex.

15. The padlock of claim 9, wherein said curved shape of said outer body is generally concave.

16. The padlock of claim 9, wherein said curved shape of said outer body is generally cylindrical.

17. A padlock according to claim 9, wherein said formation around said shackle is generally conical with a cutaway section to permit said shackle to swing between said open and closed positions.

18. A padlock according to claim 9, wherein said formation around said shackle is generally spheroidal.

19. A padlock movable between an open, released position and a closed, locked position for securing an article, said padlock comprising:

an inner body containing an associated locking mechanism;

an outer body mounted around said inner body along its longitudinal axis and adapted to resist the application of torque acting about such axis; and a shackle comprising a pair of arms joined by a connecting member, said arms and connecting member defining an aperture therebetween for receiving a component to be held by said padlock, said shackle being mounted at one end portion of said padlock;

said end portion having sloping surfaces forming a generally conical shape about said shackle when in said closed position adapted for impeding the application of a wrench to the ends of said padlock and restricting said aperture such that, in use, space between said component and said padlock is minimized to resist insertion of a tool for prying open said padlock.

20. The padlock of claim 19, wherein said outer body is cylindrical.

21. A padlock comprising a body having a longitudinal axis and a shackle lying in a plane extending in the same direction as said axis and mounted on the body for movement between a closed, locked position and an open, released position, wherein the body comprises an inner body part which mounts the shackle and an associated locking mechanism, and an outer body part mounted on the inner body part for relative rotation about the inner body part about the longitudinal axis of the body, said outer body part having a length sufficient to shield the inner body part against the application of a torque acting about the longitudinal axis of the body to force the shackle of the padlock, and the inner body having an end portion comprising a generally conical formation having surfaces on each side of said shackle plane and sloping from said body towards said axis so that the surfaces have no opposing, substantially parallel surfaces, whereby the application of the jaws of a wrench to the opposite sides of the body and shackle are impeded.

22. The padlock of claim 21, wherein said outer body part is annular.

23. The padlock of claim 21, wherein said formation of said end portion has a cutaway section to permit said shackle to swing between said open and closed positions.

* * * * *